US012448809B2

(12) United States Patent
Staff

(10) Patent No.: US 12,448,809 B2
(45) Date of Patent: Oct. 21, 2025

(54) SHADE SYSTEM

(71) Applicant: Christian Staff, Winchester, CA (US)

(72) Inventor: Christian Staff, Winchester, CA (US)

( * ) Notice: Subject to any disclaimer, the term of this patent is extended or adjusted under 35 U.S.C. 154(b) by 226 days.

(21) Appl. No.: 18/234,175

(22) Filed: Aug. 15, 2023

(65) Prior Publication Data

US 2024/0060326 A1 Feb. 22, 2024

Related U.S. Application Data

(60) Provisional application No. 63/398,478, filed on Aug. 16, 2022.

(51) Int. Cl.
*E04H 15/58* (2006.01)
*E04H 15/04* (2006.01)
*E04H 15/18* (2006.01)

(52) U.S. Cl.
CPC ..... *E04H 15/58* (2013.01); *E04H 15/18* (2013.01)

(58) Field of Classification Search
CPC ..... E04H 15/58; E04H 15/18; E04H 15/60; E04H 15/64; E04H 15/04; E04H 15/08
See application file for complete search history.

(56) References Cited

U.S. PATENT DOCUMENTS 2,720,885 A * 10/1955 Legg ..... E04F 10/02 135/120.3
5,400,813 A * 3/1995 Swan, Jr. ..... E04H 15/08 135/88.07
5,794,679 A * 8/1998 Williams ..... E06B 9/262 160/46
6,050,280 A 4/2000 Jeske
6,523,558 B1 * 2/2003 Gillis ..... E04H 15/60 135/125
6,796,359 B1 9/2004 Knutson
7,213,869 B1 * 5/2007 McClellan ..... E04H 12/2238 248/346.03
7,290,552 B1 * 11/2007 Eisbrenner ..... E04H 15/04 135/117
7,896,015 B2 3/2011 Milano, Jr. et al.
8,251,121 B1 8/2012 Casey
8,596,451 B2 * 12/2013 Merritt ..... E04H 9/14 206/541

(Continued)

FOREIGN PATENT DOCUMENTS

PL 237397 B1 4/2021

*Primary Examiner* — Noah Chandler Hawk
(74) *Attorney, Agent, or Firm* — Dentons Durham Jones Pinegar; Sarah W. Matthews; Lilly Godfrey

(57) ABSTRACT

A multi-configuration shade apparatus can include a first shade apparatus and a second shade apparatus. The first shade apparatus includes a 4-sided cover with a proximal side having a first proximal corner and a second proximal corner, a distal side having a third distal corner and a fourth distal corner, the proximal side for connection to a chain link fence and the distal side for connection to vertical supports. The first shade apparatus also includes a first vertical support for linking to the third distal corner and a second vertical support for linking to the fourth distal corner. A first clip is attached to the first proximal corner for selectively connecting the first proximal corner to the chain link fence and a second clip is attached to the second proximal corner for selectively connecting the second proximal corner to the chain link fence.

12 Claims, 8 Drawing Sheets

(56) References Cited

U.S. PATENT DOCUMENTS

| | | | | |
|---|---|---|---|---|
| D838,469 | S | 1/2019 | Morel | |
| D847,486 | S | 5/2019 | Morel | |
| 10,378,234 | B1 * | 8/2019 | Nielsen | E04H 15/64 |
| 10,557,284 | B2 | 2/2020 | Mcmillen, Jr. et al. | |
| 10,655,357 | B1 * | 5/2020 | Graham | E04H 15/30 |
| 10,876,319 | B2 * | 12/2020 | Moeggenberg | E04H 15/58 |
| 2004/0261953 | A1 * | 12/2004 | Hart | F24F 5/0035 160/80 |
| 2007/0235069 | A1 | 10/2007 | Martin | |
| 2018/0283037 | A1 | 10/2018 | Mcdonald et al. | |
| 2019/0242153 | A1 * | 8/2019 | MacKarvich | E04H 15/64 |
| 2019/0352925 | A1 | 11/2019 | Pearson | |
| 2022/0010580 | A1 | 1/2022 | Graham | |
| 2023/0332427 | A1 * | 10/2023 | Jarrell | E04H 15/08 |

* cited by examiner

SHADE SYSTEM

CROSS REFERENCE TO RELATED MATTER

The present application claims the benefit of and priority to U.S. Provisional Application No. 63/398,478, entitled SHADE SYSTEM and filed on Aug. 16, 2022, the entire contents of which are herein incorporated by reference.

BACKGROUND

The present disclosure relates to a system for providing shade and more particularly to linkable systems for providing shade in multiple configurations.

SUMMARY OF DISCLOSURE

According to the present disclosure, a multi-configuration shade system can include a first shade apparatus, where the first shade system includes a cover with a proximal side having a first proximal corner and a second proximal corner, a distal side having a third distal corner and a fourth distal corner, where the proximal side may be for connection to a chain link fence and the distal side may be for connection to vertical supports. The multi-configuration shade system may also include a first vertical support for linking to the third distal corner and a second vertical support for linking to the fourth distal corner. The first shade apparatus may include a first clip attached to the first proximal corner for selectively connecting the first proximal corner to the chain link fence and a second clip attached to the second proximal corner for selectively connecting the second proximal corner to the chain link fence. They first shade apparatus may be connectable to at least one other second shade apparatus.

According to another aspect, a multi-configuration shade system can include a first shade apparatus, where the first shade apparatus includes a 4-sided cover with a proximal side having a first proximal corner and a second proximal corner, and a distal side having a third distal corner and a fourth distal corner. The proximal side may be for connection to a chain link fence and the distal side for connection to vertical supports. The multi-configuration shade system may also include a first vertical support for linking to the third distal corner and a second vertical support for linking to the fourth distal corner. The first and second vertical supports may be extendable from a first position to a second position, where the second position has a greater length than the first position.

The first shade apparatus may include a first clip attached to the first proximal corner for selectively connecting the first proximal corner to the chain link fence and a second clip attached to the second proximal corner for selectively connecting the second proximal corner to the chain link fence. The multi-configuration shade system may further include a second shade apparatus, where the second shade apparatus includes a 4-sided cover with a proximal side having a first proximal corner and a second proximal corner, a distal side having a third distal corner, and a fourth distal corner, where the proximal side may be for connection to a chain link fence and the distal side may be for connection to vertical supports. The system may also include a third vertical support for linking to the fourth distal corner. In some embodiments, the first vertical support is extendable from a first position to a second position and the second position has a greater length than the first position. A first clip attached to the first proximal corner of the second shade apparatus may be for selectively connecting the first proximal corner to the chain link fence and a second clip attached to the second proximal corner may be for selectively connecting the second proximal corner to the chain link fence.

According to yet another aspect, a method is described for forming a multi-component shade system. The method can include selecting a first shade apparatus, the first shade apparatus having a 4-sided cover with a proximal side having a first proximal corner and a second proximal corner, a distal side having a third distal corner and a fourth distal corner, where the proximal side may be for connection to a chain link fence and the distal side may be for connection to vertical supports. The first shade apparatus may also a first vertical support for linking to the third distal corner and a second vertical support for linking to the fourth distal corner, where the first and second vertical supports are extendable from a first position to a second position, the second position having a greater length than the first position. The first shade apparatus may additionally include a first clip attached to the first proximal corner for selectively connecting the first proximal corner to the chain link fence and a second clip attached to the second proximal corner for selectively connecting the second proximal corner to the chain link fence.

The method may include selecting a second shade apparatus, the second shade apparatus having a 4-sided cover with a proximal side having a first proximal corner and a second proximal corner, and a distal side having a third distal corner and a fourth distal corner. The proximal side of the second shade apparatus may be for connection to a chain link fence and the distal side may be for connection to vertical supports. The second shade apparatus may also include a third vertical support for linking to the fourth distal corner, where the third vertical support is extendable from a first position to a second position, where the second position has a greater length than the first position. The second shade apparatus may further include a first clip attached to the first proximal corner for selectively connecting the first proximal corner to the chain link fence and a second clip attached to the second proximal corner for selectively connecting the second proximal corner to the chain link fence.

The method may further include connecting the first clip of the first proximal corner of the first shade apparatus to the chain link fence and connecting the second clip of the second proximal corner of the first shade apparatus to the chain link fence. Additionally, the method may include linking the third distal corner to the first vertical support and linking the fourth distal corner of the first shade system and the third distal corner of the second shade apparatus to the second vertical support. Further, the method may include connecting the first clip of the first proximal corner of the second shade apparatus to the chain link fence and connecting the second clip of the second proximal corner of the second shade apparatus to the chain link fence, and linking the third distal corner of the second shade apparatus to the second vertical support.

BRIEF DESCRIPTION OF DRAWINGS

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention. The components in the drawings are not necessarily to scale relative to each other. Like reference numerals designate corresponding parts throughout the several views.

DETAILED DESCRIPTION

The following provides a detailed description of particular embodiments of the present invention. Reference will now be made to the drawings in which the various elements of the illustrated configurations will be given numerical designations and in which the invention will be discussed to enable one skilled in the art to make and use the invention. The description is only exemplary of the principles of the present invention, and should not be viewed as narrowing the scope of the claims which follow, which claims define the full scope of the invention.

Various aspects discussed in one drawing may be present and/or used in conjunction with the embodiment shown in another drawing, and each element shown in multiple drawings may be discussed only once. The described features, structures, or characteristics of configurations of the invention may be combined in any suitable manner in one or more configurations. In some cases, detailed description of well-known items or repeated description of substantially the same configurations may be omitted to avoid an unnecessarily redundant description. All statements herein reciting principles, aspects, and embodiments of the invention, as well as specific examples thereof, also encompass equivalents thereof.

Figure 1:
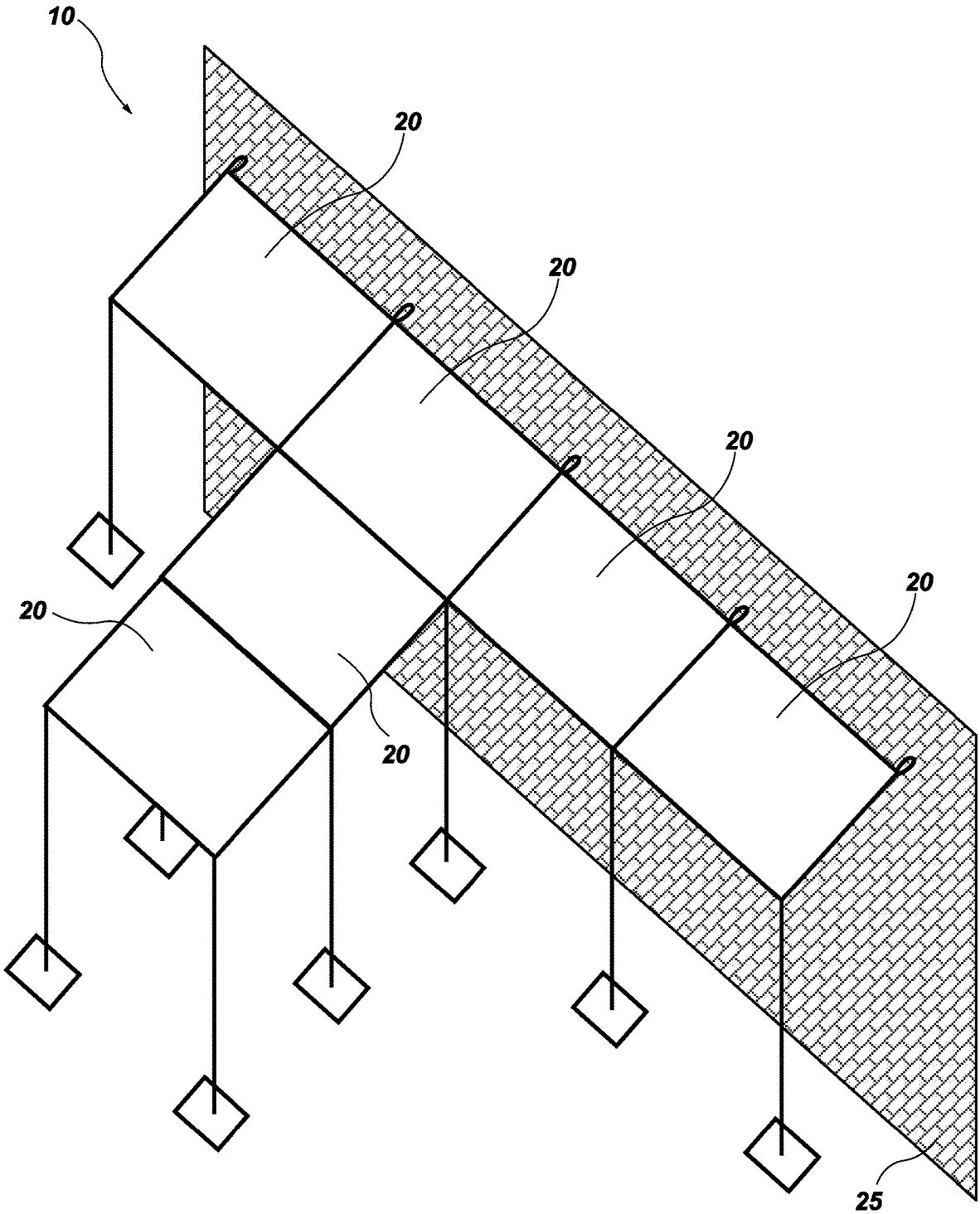
FIG. 1 is a perspective view of an exemplary configuration of a multi-component shade system.

FIG. 1 shows a multi-component portable shade system, generally indicated at 10. The system includes a plurality of covers 20. The covers 20 can be connected to each other either (i) parallel along a fence 25, or (ii) the covers 20 can be connected in a direction orthogonal to the fence line (i.e., extending away from the fence 25). As long as one or more covers 20 are attached to the fence 25, additional covers 20 can be attached to, for example, a first cover to form a multi-component or modular shade system 10. The covers 20 can include clips 29 on the proximal side 31 of the covers 20 (e.g., the side adjacent to the fence 25, see FIG. 2) for connecting the proximal side 31 of the cover 20 to the fence 25, as described in more detail below. The covers 20 can also include vertical supports 34 attached to the distal side 38 of the covers 20 (e.g., the side opposite that connected to the fence).

Figure 2:
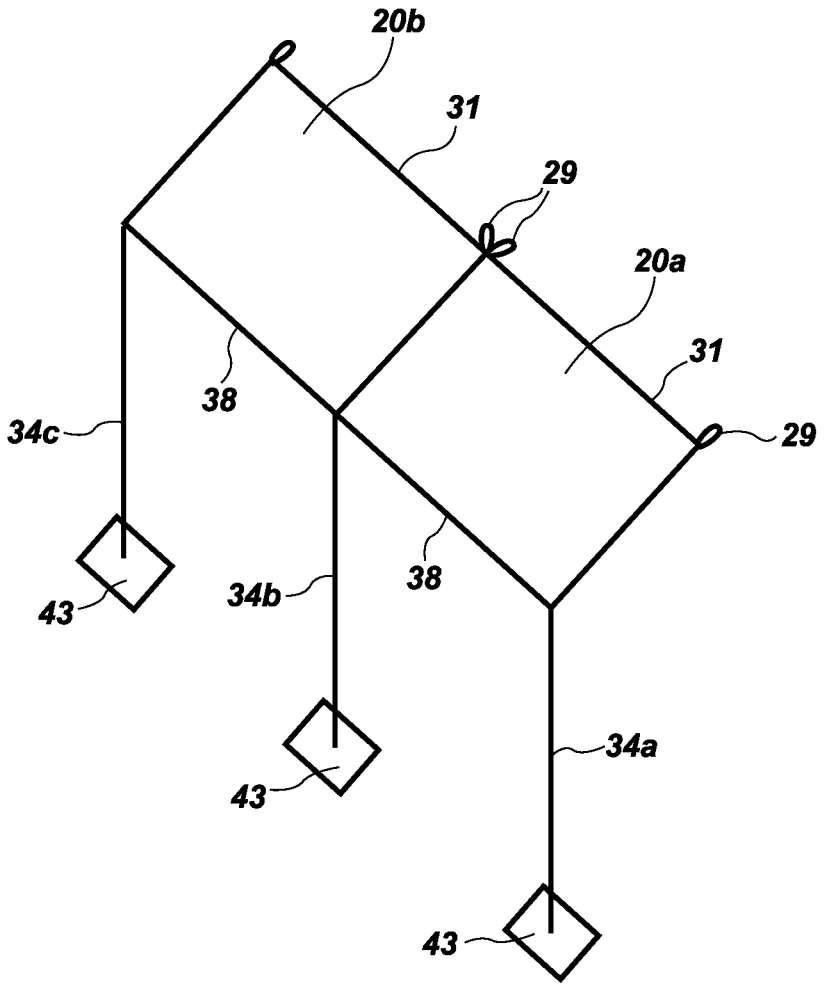
FIG. 2 is a perspective view of another exemplary configuration of a multi-component shade system.

In the exemplary configuration shown in FIG. 1 and further illustrated in FIG. 2, a user may mount or set-up a first cover system or apparatus. This first system includes a cover 20*a*, with two clips 29 disposed at a proximal side 31 of the cover 20 to attach or connect the cover 20 to a fence 25, and two vertical supports 34*a*, 34*b* attachable to a distal side 38 of the cover 20 to support the distal side 38 of the cover 20. Each of the vertical supports 34 can have a base 43 to securely hold the vertical support 34 in place.

The user can attach each corner of the proximal side 31 (provided with clips 29) of the cover 20 to the fence 25. Clips 29 can be any suitable fastener or fastening device. A clip 29 includes, but is not limited to, a tie, a snap, a pin, a toggle, a button, a buckle, a clasp, a carabiner, a D-buckle, a clip, a hook, a spring snap hook, a dual carabiner, a detent and pin assembly, etc. After attaching the proximal side 31 of the cover 20*a* to the fence via clips 29, the first user can then attach a first vertical support 34*a* to one corner of the distal side 38 of the cover 20, and secure the first vertical support 34*a* to a base 43. Finally, the user can attach a second vertical support 34*b* to a second corner of the distal side 38, and secure the second vertical support 34*b* to a base 43.

According to an exemplary method, the user need only install a second shade system including a cover 20*b* and a single vertical support 34*c*. The second shade system can share one of the vertical supports (e.g., 34*b* in FIG. 2) of the first shade system. That is, the second shade system can include only a cover 20*b*, two clips 29 at a proximal side 31 of the cover 20 to attach or connect the cover to a fence 25, and one vertical support 34*c* having a base 43 to securely hold the vertical support 34*c* in place. The user can attach each corner of the proximal side 31 (provided with clips 29) of the cover 20 to the fence 25. The corner of the proximal side 31 that is closest or adjacent to the first shade system (which is already attached to the fence 25) can be attached either directly to the fence 25, or can be attached to the corner of the first shade system, or to the clip 29 of the first shade system. In some embodiments, the clip of the second cover can attach to the corner of the first cover via one or more slots, holes, pins, etc. Next, the user can attach a corner on the distal side 38 that is adjacent to the first shade system to the vertical support 34*b* of the first shade system. Finally, the user can attach a vertical support 34*c* to a second corner of the distal side 38, and secure the vertical support 34 to a base 43.

Connecting two shade systems in this manner allows for a plurality of modular shade system configurations. Lateral connections, or connections that are parallel to the fence 25, enable the use of fewer vertical supports 34, since the vertical supports 34 can be shared between two systems connected laterally.

Figure 3:
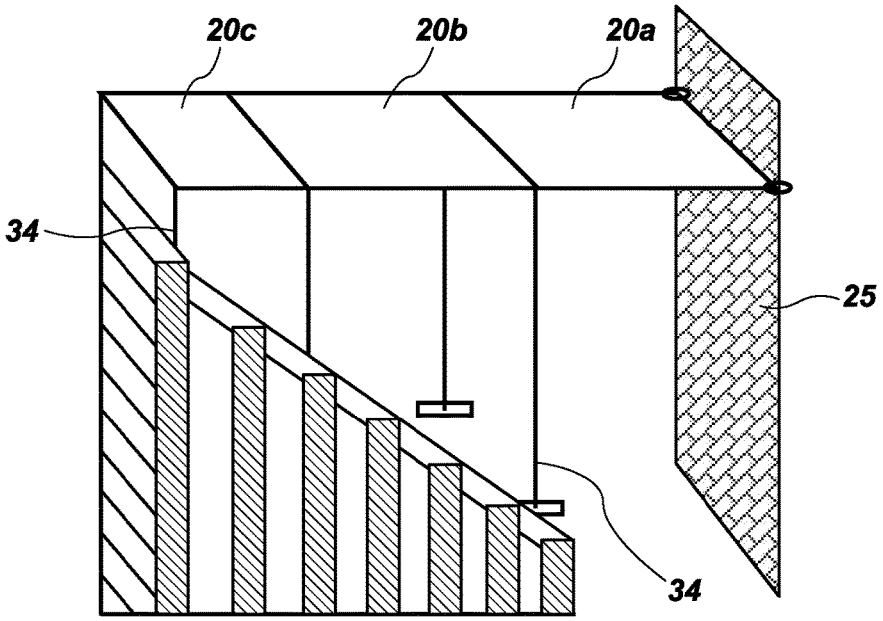
FIG. 3 is a perspective view of another exemplary configuration of a multi-component shade system.
Figure 4:
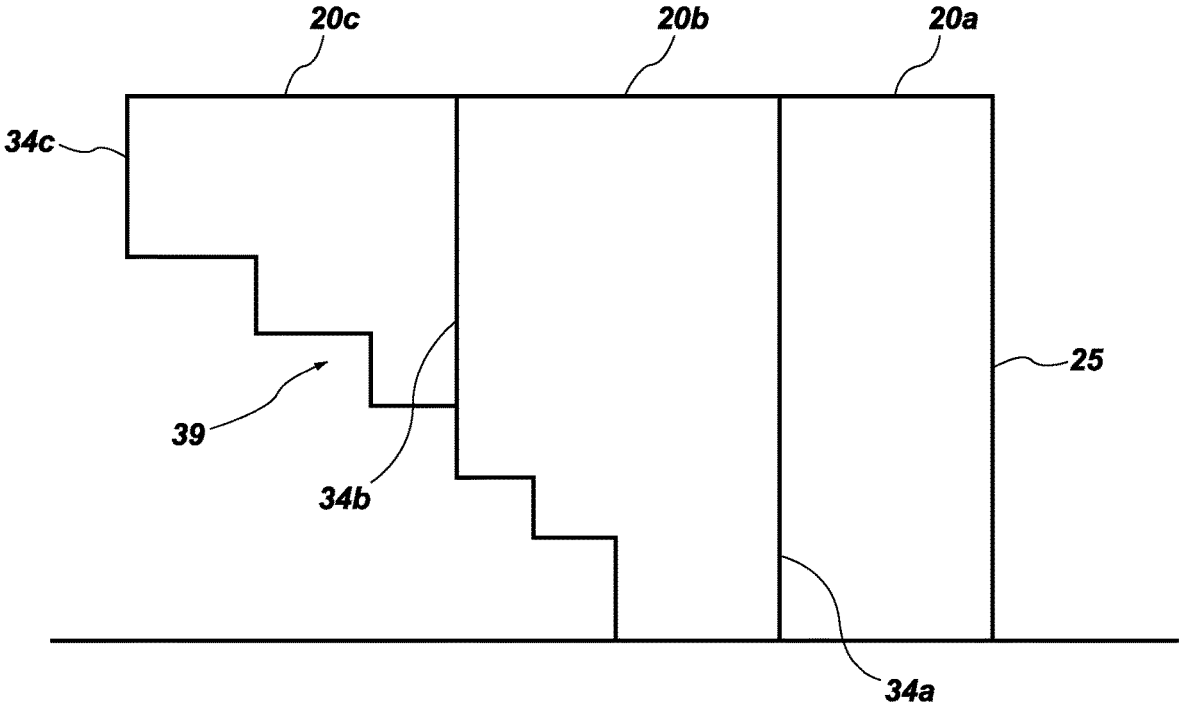
FIG. 4 is a side view of the exemplary configuration of FIG. 3.

Shade systems can also be connected orthogonally, as seen in FIG. 1, and as further illustrated in FIGS. 3-4. That is, a second shade system can be attached to a first shade system in a direction extending away from the fence 25. This type of connection requires second and subsequent shade systems to use two vertical supports 34, since a vertical support 34 is not shared laterally between systems like the lateral connection described above. This connection can also allow multiple systems to be connected in a way that creates a large, integral or single section of shade along, for example, bleachers.

As seen in FIGS. 3-4, a first shade system with a first cover 20*a* can be attached to a fence 25 (similar to the method described above). A second shade system with a second cover 20*b* can be attached directly behind the first shade system, on the side of the first shade system away from the fence ("behind" being relative to the fence 25, which is in front of the first shade system). That is, the proximal side 31 clips 29 (not illustrated) of the second shade system are attached to the distal side 38 vertical supports 34 of the first shade system. In this specific example, the multi-component shade system is extending away from the fence 25, and also covering bleachers 39. This example can include vertical supports 34 that have a varying height to allow the covers 20*a*, 20*b*, and 20*c* to remain at a generally constant height even as the multi-component system 10 spans bleachers that vary in height. The vertical supports 34 can be connectable to bleachers rather than bases 43, as detailed below.

Vertical supports 34 can have varying heights. In one example, vertical supports 34 can have adjustable heights and can be telescoping or non-telescoping. The heights can be adjusted to particular pre-determined intervals, or can be continuously adjusting. In other configurations, multiple vertical supports 34 having varying heights can be provided in a single kit to allow for various heights. Or in other configurations, the vertical supports 34 can be provided in a single standard height. In one example, a telescopic adjustable pole having a maximum length of about 2.4 meters (8 feet) can be used as a vertical support 34.

"Base" as used herein means any type of supporting device to hold a vertical support 34 in place. The base 43 can be provided in different configurations. In one example, the base 43 is formed of a plastic material that can be filled with water or sand to provide a stable base. In other examples, the base 43 is formed of a clip that can be removably attached to a bleacher (such as clamped to the lip of the bleacher). Such bleacher clips or clamps are known. The base 43 can also be provided with a design. In configurations where the shade system 10 is specifically designed for use in baseball games, the base 43 can be designed to look like the base used in a baseball game. Other designs can also be used. A base 43 made of plastic and designed to be filled with water or sand can be made of a rigid plastic that remains in a particular shape (such as a rectangle shape) or it can be made of a soft plastic that collapses for storage. A base 43 can also be one or more stakes attached to a vertical support 34.

Figure 5:
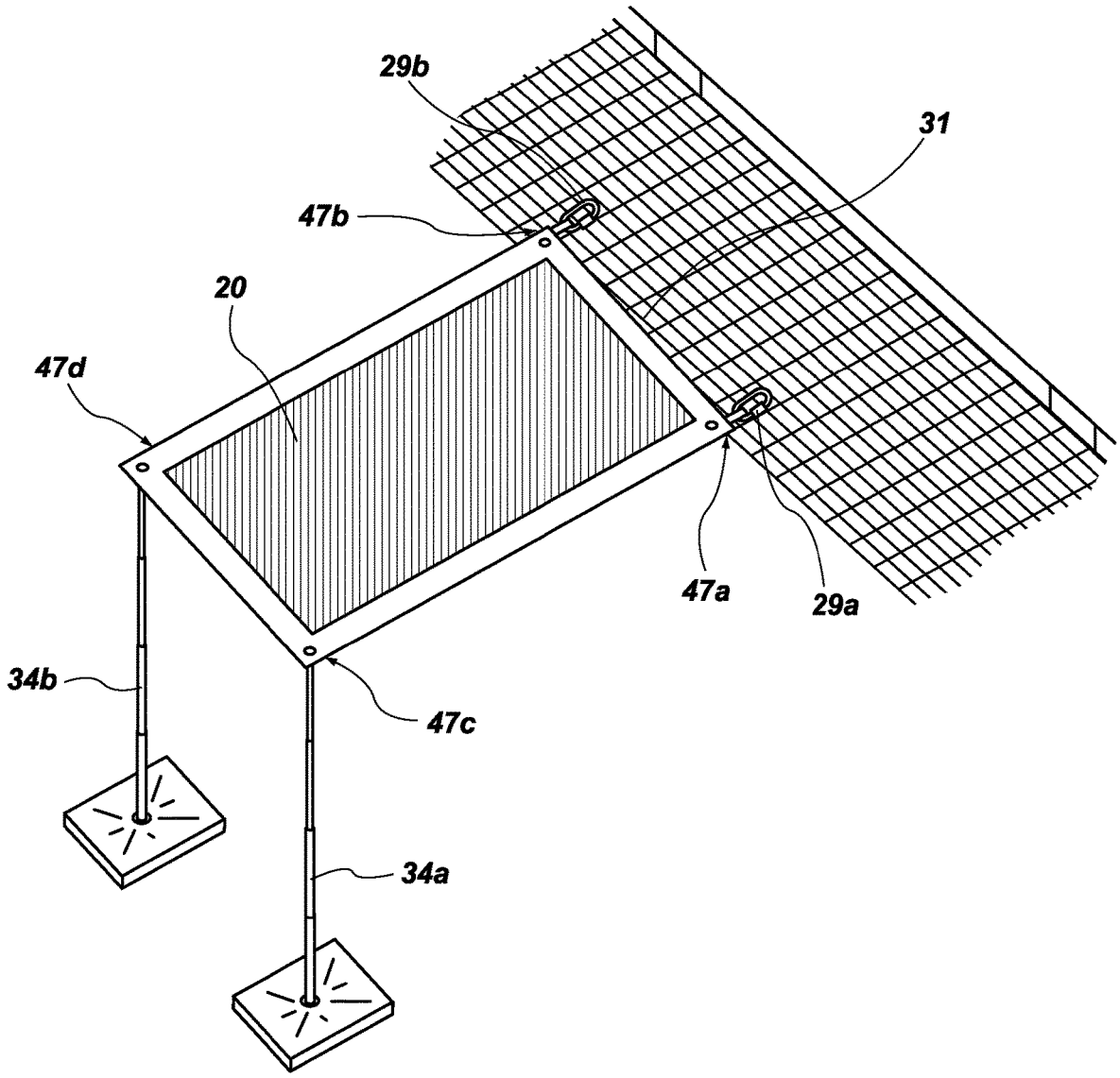
FIG. 5 is a perspective view of another exemplary configuration of a multi-component shade system showing a single shade apparatus.
Figure 6:
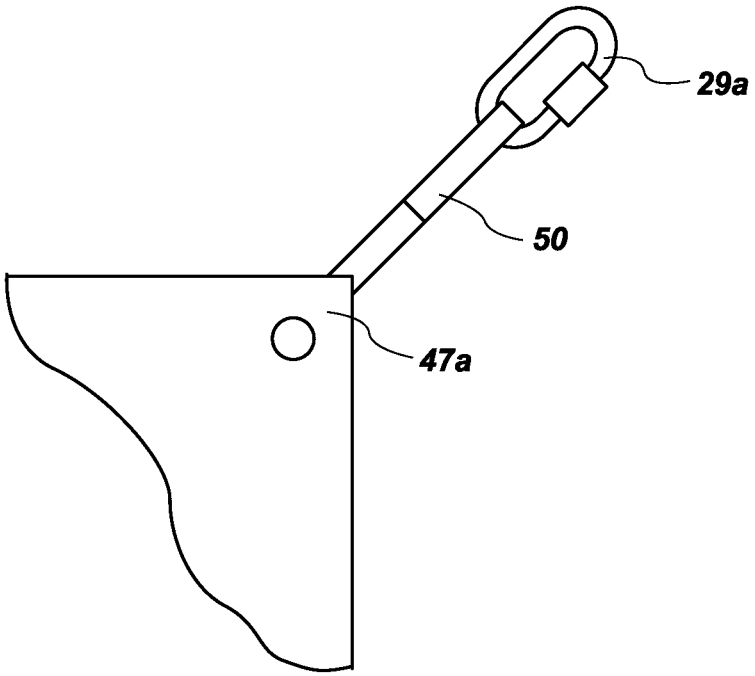
FIG. 6 is a top view of an exemplary connector or clip attached to a proximal corner of a cover of a shade apparatus.
Figure 7:
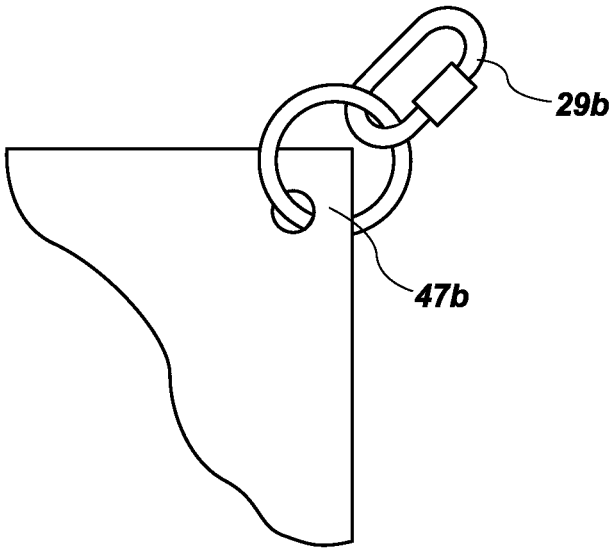
FIG. 7 is a top view of another exemplary connector or clip attached to a proximal corner of a cover of a shade apparatus.

FIG. 5 shows a configuration of a shade system with a 4-sided cover 20. The cover 20 has a proximal side 31 with a first proximal corner 47*a* and a second proximal corner 47*b*. The first proximal corner 47*a* is connected to a clip 29*a*. Clip 29*a* can be integral to the corner 47*a*, or can be separately attached or otherwise in connection with the corner 47*a*. For example, FIG. 6 shows a clip 29*a* that is attached to a corner 47*a* via a strap 50 that has an adjustable length. In this example, the distance from the corner 47*a* of the cover 20 for attachment to the fence (or other structure) can easily be adjusted. In other configurations, an adjustable strap 50 is not provided. FIG. 7 shows an example of a clip 29*b* that is integral to the corner 47*a*.

Figure 8:
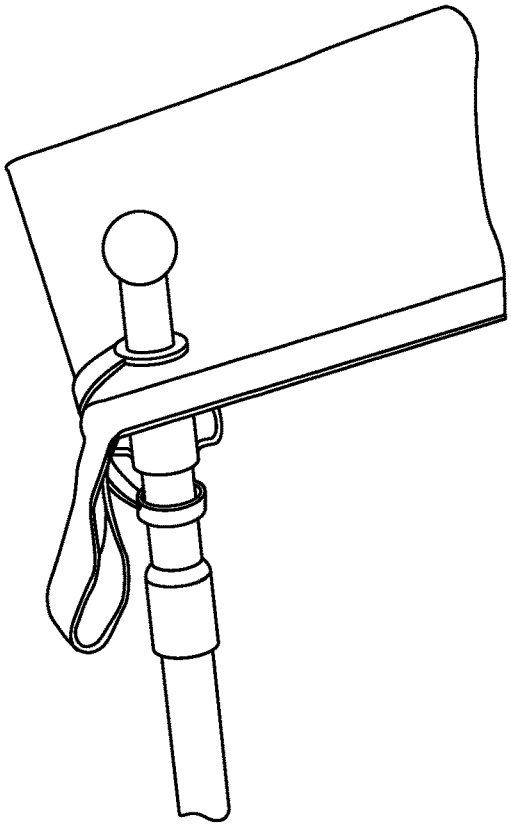
FIG. 8 is a perspective view of the distal side of a shade apparatus, with a distal corner connected to a vertical support.
Figure 9:
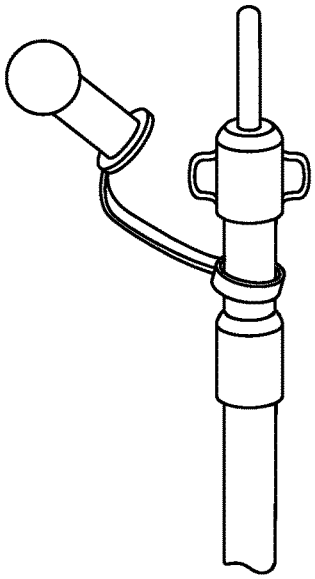
FIG. 9 is a perspective view of the vertical support shown in FIG. 8.

The 4-sided cover 20 of FIG. 5 also has a distal side 38 with a third distal corner 47*c* and a fourth distal corner 47*d*. Each of the distal corners 47*c* and 47*d* are for connection to a vertical support 34. Distal corner 47*c* is for connection to a first vertical support 34*a* and distal corner 47*d* is for connection to a second vertical support 34*b*. The distal corners can be provided with any suitable connectors. For example, distal corners 47*c*, 47*d* can be provided with a void (such as a void with a grommet), and the vertical supports 34 can be provided with an extension that fits through this void. The vertical supports 34 may also include a cap to fit over the extension to secure the extension within this void. See FIGS. 8-9. Other connectors, clips, etc., can also be used to connect the distal side 38 of the cover to a vertical support 34.

Figure 10:
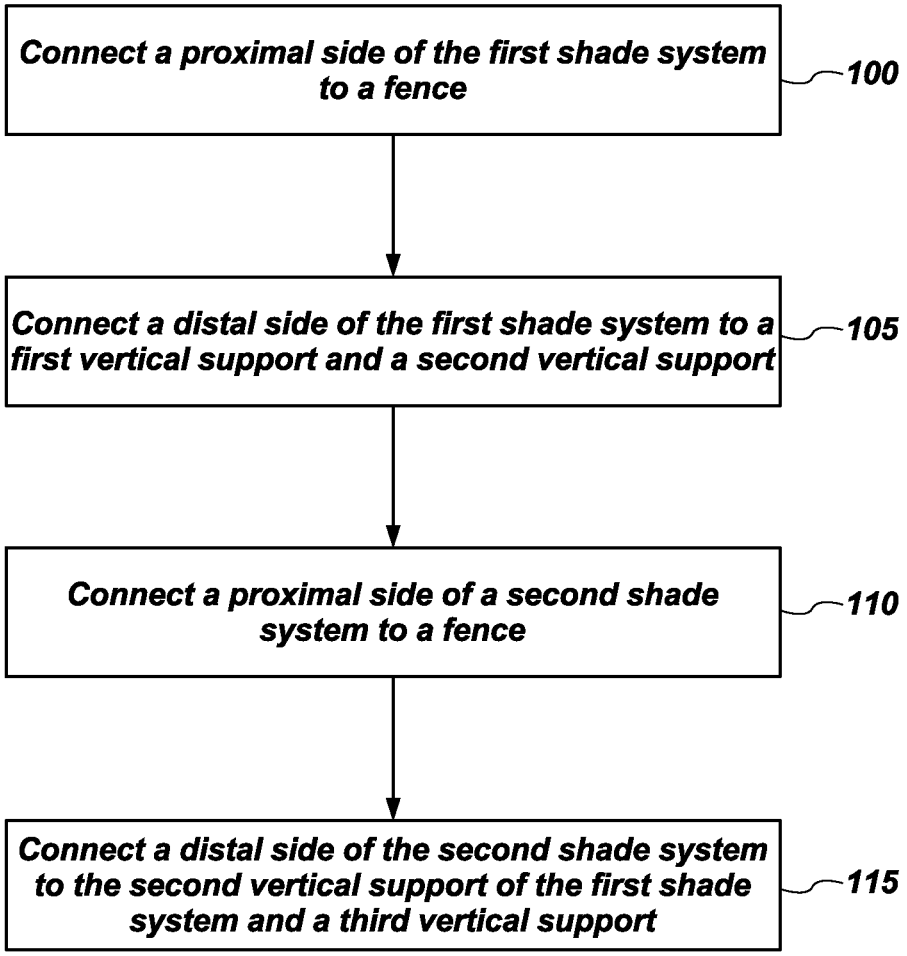
FIG. 10 is a diagram of an exemplary method described herein to form a multi-component shade system.

FIG. 10 shows exemplary steps that can be taken, in some embodiments, according to a method described herein to form a multi-component portable shade system. While methods are described in discrete steps in a particular order for the sake of clarity, the steps for the exemplary methods described herein do not require a particular order, and more than one step may be performed at the same time. For example, a later step may begin before an earlier step is completed. Or, a later step may be completed before an earlier step is started. More specifically, the covers (e.g., cover 20) described herein can be mounted and positioned by first linking the proximal side to a fence and then linking the distal side to one or more vertical supports, or by first linking the distal side to one or more vertical supports and then linking the proximal side to a fence, or both steps could be performed simultaneously, etc.

With reference to FIG. 10, a user may first connect a proximal side of the first shade system to a fence (step 100). Next, the user can connect a distal side of the first shade system to a first vertical support and a second vertical support (step 105). This completes the set-up for the first shade system. Next, a user (either the first user or a second user) can attach a second shade system laterally to the first shade system to form a multi-component portable shade system.

The user can connect a proximal side of the second shade system to a fence (step 110). The first corner of the second shade system can be either directly attached to the fence, or the first corner of the second shade system can be connected to the second corner of the first shade system (and therefore the first corner of the second shade system is connected to the fence through the second corner of the first shade system). Next, the distal side of the second shade system can be connected to the second vertical support of the first shade system and a third vertical support of the second shade system (step 115). This creates a configuration whereby two shade systems or apparatuses that would each require two vertical supports are supported by three vertical supports, with one shared vertical support between the two shade apparatuses.

Additional shade systems can be connected to the multi-component portable shade system either laterally or orthogonally as described herein. In other words, additional shade systems can be daisy-chained together to provide a desired shade area, such as over bleachers and/or along a fence line.

Figure 11:
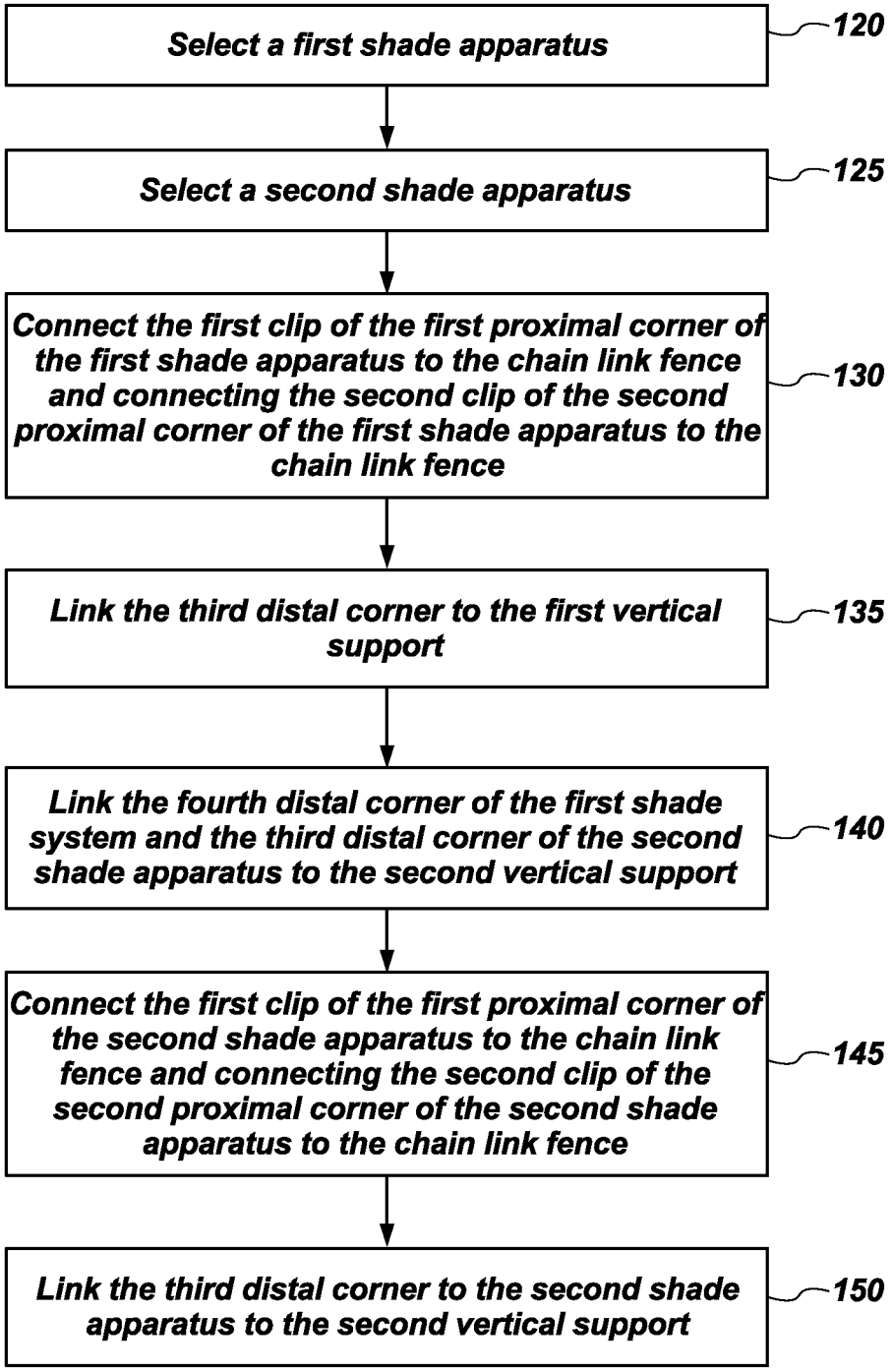
FIG. 11 is a diagram of another exemplary method described herein to form a multi-component shade system.

FIG. 11 shows exemplary steps according to another method as described herein for linking two shade apparatuses in a lateral configuration. The method can include selecting a first shade apparatus (step 120). The first shade apparatus can include a 4-sided cover 20 with a proximal side 31 having a first proximal corner and a second proximal corner, and a distal side 38 with a third distal corner and a fourth distal corner. The first shade apparatus can also include two vertical supports 34: a first vertical support for linking to the third distal corner and a second vertical support for linking to the fourth distal corner of the first cover 20 (the second vertical support will also be linked to a distal corner of the second cover 20 as described in more detail below). The first shade apparatus can also include a first clip attached to the first proximal corner for selectively connecting the first proximal corner to a chain link fence and a second clip attached to the second proximal corner for selectively connecting the second proximal corner to the chain link fence.

The method also includes selecting a second shade apparatus (step 125). The second shade apparatus is similar to the first shade apparatus, but need only include a single vertical support. The second shade apparatus could include two supports, but only one is needed because the second shade apparatus can share one of the vertical supports of the first shade apparatus when connected laterally.

After selecting the first and second shade apparatuses, a user can then connect the first clip of the first proximal corner of the first shade apparatus to the chain link fence and connect the second clip of the second proximal corner of the first shade apparatus to the chain link fence (step 130). Next, the user can link the third distal corner to the first vertical support (135). The second vertical support is shared between the first shade apparatus and the second shade apparatus, and the user can link the fourth distal corner of the first shade apparatus and the third distal corner of the second shade apparatus to the second vertical support (140).

The user can next connect the first clip of the first proximal corner of the second shade apparatus to the chain link fence and connect the second clip of the second proximal corner of the second shade apparatus to the chain link fence (145). And then the user can link the third distal corner of the second shade apparatus to the second vertical support (150).

To link two shade apparatuses orthogonally, the first shade apparatus is attached to the fence as described above. Then, the user can next connect the clips of the proximal side of the second shade apparatus to the distal side of the first shade apparatus. The user can then link the distal corners each to a vertical support. If needed (such as in configurations with bleachers), the user can attach the vertical supports to the bleachers, and/or adjust the vertical supports to decrease the length of the support to maintain a standard height of the multi-component system as it extends across bleachers.

Many portable shade systems require both vertical and lateral supports for the cover. In some configurations, the system described herein specifically lacks any lateral supports for the cover. That is, the cover is supported only vertically (by either the fence on the proximal side or the vertical supports on the distal side). The system described herein offers protection from sun and/or weather. For example, it can be used for spectators at games such as baseball games, which typically have a chain link fence between the spectators and the playing field. The covers can be numerous shapes and sizes. Many examples show the covers as being generally rectangular, but other shapes and sizes can also be used (e.g., triangular, circular, ovular, etc.). In some examples, a kit can be sold with covers having pre-selected sizes, such as a small, medium, and/or large cover. Covers can also be customized for team colors, printed with team logos or other patterns, etc.

Covers can be made from any material desired. For example, materials that are weather-resistant, water proof, etc. can be used. Fabrics such as cloth, or fabrics that incorporate plastics can also be used; additionally, and/or alternatively, fabrics can be coated to achieve the desired weather-resistance. In some examples, polyester, canvas, nylon, polyethylene, and/or polypropylene can be used. The cover described herein is not limited to a particular type of fabric or material.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

As used in this specification and the appended claims, singular forms such as "a," "an," and "the" may include the plural unless the context clearly dictates otherwise. Thus, for example, reference to "a cover" may include one or more of such cover, and reference to "the vertical support" may include reference to one or more of such vertical supports.

As used herein, the term "generally" refers to something that is more of the designated adjective than not, or the converse if used in the negative. As used herein, the term "about" is used to provide flexibility to a numerical range endpoint by providing that a given value may be "a little above" or "a little below" the endpoint while still accomplishing the function associated with the range, for example, "about" may be within 10% of the given number or given range. As used herein, a plurality of items, structural elements, compositional elements, and/or materials may be presented in a common list for convenience. However, these lists should be construed as though each member of the list is individually identified as a separate and unique member.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 5 to about 60" should be interpreted to include not only the explicitly recited values of about 1 to about 5, but also include individual values and sub-ranges within the indicated range. Thus, included in this numerical range are individual values such as 6, 7, 8, 9, etc., through 60, and sub-ranges such as from 10-20, from 30-40, and from 50-60, etc., as well as each number individually. This same principle applies to ranges reciting only one numerical value as a minimum or a maximum. Furthermore, such an interpretation should apply regardless of the breadth of the range or the characteristics being described. Additionally, the word "connected" and "coupled" is used throughout for clarity of the description and can include either a direct connection or an indirect connection.

Although the foregoing disclosure provides many specifics, such as use of the formulation for transdermal delivery, it will be appreciated other applications, such as use for topical delivery, are contemplated and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

Furthermore, if any references have been made to patents and printed publications throughout this disclosure, each of these references and printed publications are individually incorporated herein by reference in their entirety.

The invention claimed is:

1. A method of forming a multi-component shade system, the method comprising:

selecting a first shade apparatus, the first shade apparatus comprising:

a 4-sided cover with a proximal side having a first proximal corner and a second proximal corner, and a distal side having a third distal corner and a fourth distal corner, the proximal side for connection to a chain link fence and the distal side for connection to vertical supports;

a first vertical support for linking to the third distal corner and a second vertical support for linking to the fourth distal corner, wherein the first and second vertical supports are extendable from a first position to a second position and wherein the second position has a greater length than the first position; and a first clip attached to the first proximal corner for selectively connecting the first proximal corner to the chain link fence and a second clip attached to the second proximal corner for selectively connecting the second proximal corner to the chain link fence;

selecting a second shade apparatus, the second shade apparatus comprising:

a 4-sided cover with a proximal side having a first proximal corner and a second proximal corner, and a distal side having a third distal corner and a fourth distal corner, the proximal side for connection to a chain link fence and the distal side for connection to vertical supports;

a third vertical support for linking to the fourth distal corner, wherein the third vertical support is extendable from a first position to a second position and wherein the second position has a greater length than the first position; and a first clip attached to the first proximal corner for selectively connecting the first proximal corner to the chain link fence and a second clip attached to the second proximal corner for selectively connecting the second proximal corner to the chain link fence;

connecting the first clip of the first proximal corner of the first shade apparatus to the chain link fence and connecting the second clip of the second proximal corner of the first shade apparatus to the chain link fence;

linking the third distal corner of the first shade apparatus to the first vertical support;

linking the fourth distal corner of the first shade apparatus and the third distal corner of the second shade apparatus to the second vertical support;

connecting the first clip of the first proximal corner of the second shade apparatus to the chain link fence and connecting the second clip of the second proximal corner of the second shade apparatus to the chain link fence; and linking the third distal corner of the second shade apparatus to the second vertical support.

2. The method of claim 1, wherein the first clip of the first shade apparatus comprises a tie, a snap, a pin, a toggle, a button, a buckle, a clasp, a carabiner, a D-buckle, a clip, a hook, a spring snap hook, a dual carabiner, or a detent and pin assembly.

3. The method of claim 2, wherein the first clip of the first shade apparatus comprises a carabiner attached to the first proximal corner through a strap.

4. The method of claim 3, wherein the strap is adjustable in length.

5. The method of claim 2, wherein the first clip of the first shade apparatus is integral with the first proximal corner.

6. The method of claim 1, wherein the third distal corner of the first shade apparatus comprises a void having a grommet and the first vertical support links to the third distal corner through the void.

7. The method of claim 6, wherein the first vertical support comprises an extension for extending through the void and a cap for securing the extension in place within the void.

8. The method of claim 1, wherein the 4-sided covers of the first and second shade apparatus comprise a weather-resistant material.

9. The method of claim 1, further comprising selecting a third shade apparatus and connecting proximal corners of the third shade apparatus to the first and second vertical supports of the first shade apparatus.

10. A kit for a multi-configuration shade system, the kit comprising:

a first shade apparatus, the first shade apparatus comprising:

a 4-sided cover of a first size, with a proximal side having a first proximal corner and a second proximal corner, a distal side having a third distal corner and a fourth distal corner, the proximal side for connection to a chain link fence and the distal side for connection to vertical supports;

a first vertical support for linking to the third distal corner and a second vertical support for linking to the fourth distal corner, wherein the first and second vertical supports are extendable from a first position to a second position and wherein the second position has a greater length than the first position;

a first clip attached to the first proximal corner for selectively connecting the first proximal corner to the chain link fence and a second clip attached to the second proximal corner for selectively connecting the second proximal corner to the chain link fence;

a second shade apparatus, the second shade apparatus comprising:

a 4-sided cover of a second size, with a proximal side having a first proximal corner and a second proximal corner, and a distal side having a third distal corner and a fourth distal corner, the proximal side for connection to a chain link fence and the distal side for connection to vertical supports;

a third vertical support for linking to the third distal corner and a fourth vertical support for linking to the fourth distal corner, wherein the third and fourth vertical supports are extendable from a first position to a second position and wherein the second position has a greater length than the first position;

a first clip attached to the first proximal corner for selectively connecting the first proximal corner of the second shade apparatus to the first vertical support of the first shade apparatus;

a second clip attached to the second proximal corner for selectively connecting the second proximal corner of the second shade apparatus to the second vertical support of the first shade apparatus;

a third shade apparatus having a 4-sided cover of a third size, where the first size is smaller than the second size and the second size is smaller than the third size; and a plurality of bases for securing at least the first, second, third, and fourth vertical supports.

11. The kit of claim 10, wherein the kit does not include lateral supports.

12. The kit of claim 10, wherein the first vertical support comprises an extension and a cap, the extension for linking through a void in the third distal corner of the first shade apparatus.

* * * * *